United States Patent [19]

Oldfelt et al.

[11] Patent Number: 4,704,047

[45] Date of Patent: Nov. 3, 1987

[54] LAND DRAINAGE SYSTEM

[75] Inventors: Sven Oldfelt, Vaxholm, Sweden; Tage Fridolfsson, St. Germain-en Laye, France

[73] Assignee: Oy Wartsila AB, Helsinki, Finland

[21] Appl. No.: 855,064

[22] Filed: Apr. 23, 1986

[30] Foreign Application Priority Data

Apr. 24, 1985 [GB] United Kingdom ..... 8510435

[51] Int. Cl.[4] ..... E02B 11/00

[52] U.S. Cl. ..... 405/37; 405/43

[58] Field of Search ..... 405/36, 37, 43, 48, 405/258

[56] References Cited

U.S. PATENT DOCUMENTS

| | | | |
|---|---|---|---|
| 4,348,135 | 9/1982 | St. Clair | 405/36 |
| 4,389,138 | 6/1983 | Soderstrom | 405/43 |
| 4,462,184 | 7/1984 | Cunningham | 405/37 X |
| 4,488,963 | 12/1984 | Hellers | 210/170 |
| 4,583,880 | 4/1986 | Henttonen | 405/36 |

FOREIGN PATENT DOCUMENTS 1347965 2/1974 United Kingdom .

*Primary Examiner*—David H. Corbin

*Attorney, Agent, or Firm*—Howson and Howson

[57] ABSTRACT

A land drainage system comprising sub-soil tubes (1) connected to a suction container (3) has the container evacuated by a dual function system comprising liquid pumping means (4) and air extracting means (6). A reservoir (5) can contain liquid to be passed into the soil (e.g. for irrigating the land).

17 Claims, 2 Drawing Figures

LAND DRAINAGE SYSTEM

Figure 1:
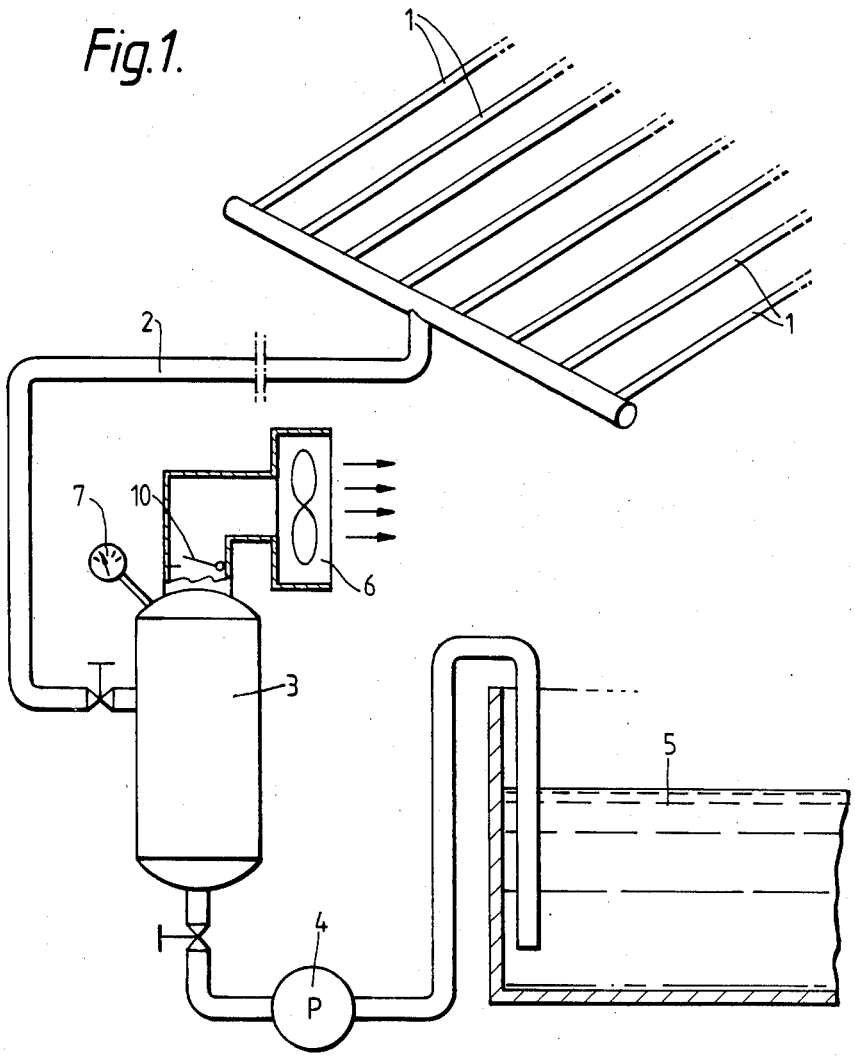

The invention relates to a system for draining and optionally also irrigating an area of ground such as a sports ground, a park, arable land or the like, said system comprising a plurality of tubes under the ground surface and means for withdrawing water from said area through said tubes to drain the area. A system according to the invention can optionally also be used for pumping water through said tubes for irrigating said area.

It has been suggested to use an underground tube system connected to a pump for draining and/or irrigating an outdoor area, in particular a sports ground or the like. Draining is carried out by connecting the suction side of the pump to the tube system, whereby water from the area to be drained is sucked through a number of small openings in the tubes and through the tubes to the pump. For irrigating purposes, the same pump is used to pump water through the tube system and expel it through its openings into the ground.

One significant problem with known systems of the kind referred to is that draining by means of pumping causes problems because, when the free water has been removed from a part of the ground to be drained, air is sucked into the tube system within this part and this air considerably affects the functioning of the pump and reduces the suction in the other parts of the tube system where there is still free water to be removed.

The present invention seeks to eliminate the problem referred to above and to create a drainage system in which the occurrence of air in the tube system does not disturb the function of the drainage system. According to the invention the problems referred to are at least reduced and at best eliminated by using a dual function system for withdrawing water from said ground which dual function system comprises a liquid pumping means, such as a displacement pump, an ejector or the like, and air extracting means (hereafter referred to as fan means) for withdrawing air from the tube, preferably a fan means capable of transporting large volumes of air. The use of a dual function system makes it possible to keep the pressure in the tube system at a sufficiently low level below atmospheric pressure to withdraw water from the ground even when substantial volumes of air are being sucked into the tube system. A fan means can easily transport large volumes of air, and consequently, the air in the suction system will be sucked away by the fan means, while the liquid pumping means continues to effectively pump water.

A secondary problem in suction drainage systems for outdoor areas is that particles from the ground are easily sucked into the tube system, where they may cause clogging or other functional disturbances. One known solution is to have the suction tubes embedded in beds of carefully purified coarse sand, but it is difficult to keep the sand clean, and further, providing such sand beds over a large area is expensive. Another possibility is to use only very small suction openings in the tube walls, but if the pumping effect is decreased by the occurrence of air in the system, it is very difficult to obtain sufficiently effective suction through very small openings. Since the invention provides a solution to the problem of ineffective suction, the invention also makes it possible to solve the secondary problem of blockage, simply by using suction openings with a sufficiently small area, that is, a free area of at the most 15 $mm^2$, preferably at the most 10 $mm^2$. It has been found that in order to obtain the most effective draining, the suction openings should be spaced along the tubes with a separation distance of at least 20 cm, preferably at least 30 cm.

The purpose of the fan means is to maintain a sufficiently low pressure within the suction system. For indicating when the fan means is to be switched on, the system may be provided with a sensor arranged to detect a rise in pressure (i.e. a reduction in suction) due to air flow through a number of tubes. The sensor may be arranged to automatically switch on the fan means for at least those tubes where the presence of air in the tubes has been indicated. Alternatively, the sensor may give a signal to an operator. The sensor may be an ordinary pressure gauge with a suitable signal trigger means.

Another way to improve the sucking of water from the ground into the tubes is to use tubes of special design. Instead of using circular tubes, it is more convenient, in a system according to the invention, to use tubes having a cross section with a concave underside and to locate the water suction openings in the upper portion of the concave underside. With this arrangement, the concave underside of the tubes forms a kind of suction duct in the ground below the tube. When tubes of this form are located in the ground, the speed of the water flow causes by the suction in the tubes is very low, because of the large cross-section area of each tube. The lower the flow speed of water into a tube the less likely it will be that particles from the ground will be carried into the tubes, which means that the water sucked into the tubes remains relatively clean.

A system according to the invention can also be used for irrigation by pumping water into the ground through the tubes, and this mode of operation may be used for purposes other than pure irrigation of the soil. For example, if there is a risk of freezing during a cold night, freezing can be avoided or defrosting obtained by irrigating the ground with water having a temperature well above freezing point.

In order to save money, water other than drinking water may be used for irrigating the ground by means of a system according to the invention. Treated sewage water is well suited for this purpose since a measure of ground fertilization may be obtained in this case.

In certain regions, the water available for irrigation is not completely salt free. After a number of repeated irrigation operations a considerable amount of salt can accumulate in the soil. This salt, and may be also other accumulated undesirable materials, usually has a deletious effect on the fertility of the soil. A system according to the invention may be used for leeching out, for instance, salt depositions of the kind referred to by means of frequently repeated irrigation and draining operations.

Figure 2:
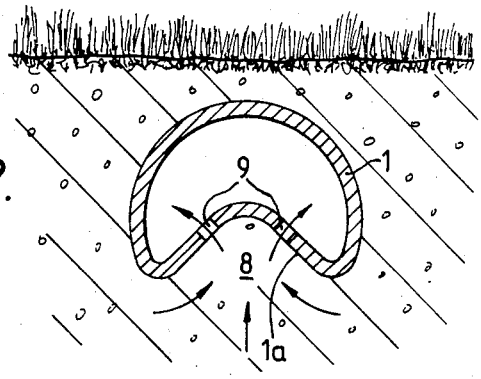

The invention will now be further described, by way of example, with reference to the accompanying drawing, in which FIG. 1 is a schematic representation of a general arrangement of a system according to the invention, and FIG. 2 is a cross-sectional view of a drainage/irrigation tube, such as used for the system of FIG. 1, embedded in the ground.

In FIG. 1, a plurality of ground tubes 1 are embedded in an area of ground to be drained or irrigated. A main tube 2 connects the ground tubes 1 with a suction container 3, to the bottom of which a liquid pump 4 of any suitable kind is connected. At the side remote from the suction container 3, the pump 4 is connected to a reservoir 5 of any suitable kind, such as a tank, a water reservoir, a pond, a lake or a river. If it is desired to combine the pumping action with some kind of treatment of the liquid in the reservoir 5, such as aerating or agitating, it is possible to replace the liquid pump 4 by an ejector pumping system of the kind shown in U.S. Pat. No. 4,488,963. Water from the reservoir 5 will then be circulated as the working medium in the ejector pump.

As water in the ground surrounding the tubes 1 is sucked away, some parts of the area will be drained faster than the other parts. Eventually, therefore water will no longer be being sucked into the tubes in the fastest drained part of the area, and air will be sucked into the tubes leading from this part. When considerable volumes of air enter the tube 2 and flow into the suction container 3, the liquid pump 4 will no longer be able to maintain a sufficiently low pressure in the container 3. Due to this, the suction efficiency of the tubes 1 drops rapidly. In order to avoid this, a high capacity fan 6 is connected to the top of the suction container 3. This fan 6 is switched on to lower the pressure in the air volume in the suction container 3, when a pressure gauge 7, connected to the interior of the suction container 3, shows that the pressure in the container is not low enough. With the fan 6 switched on, draining of the whole area can go on effectively, despite the fact that more and more air is sucked through the tubes 1 and the tube 2 to pass into the suction container 3. The fan 6 should desirably be dimensioned to be able to produce a pressure drop of about 20% of atmospheric pressure in the suction container 3 even in the case when air is being sucked through all the tubes 1 of the system. A flap valve 10 prevents air entering the container 3 via the fan 6.

To permit the system shown in FIG. 1 to be used for irrigating purposes, the working direction of the pump 4 has to be reversed and water is then drawn by the pump 4 from the reservoir 5 and fed to the tube 2 and into the tubes 1. In this case suitable arrangements should be made in order to prevent any water flowing to the fan 6. This can be ensured; for instance, by bypassing the suction container 3 via a by-pass tube (not shown) connecting the pump 4 directly to the tube 2.

FIG. 2 shows a preferred cross section for a tube 1 intended for use in a system according to the invention. The tube shown in FIG. 2 has a concave bottom surface 1*a* forming a kind of natural duct 8 in the ground below the tube. In the top portion of the concave surface 1*a* are suction openings 9 with a free cross section area of at the most 15 $mm^2$, preferably at the most 10 $mm^2$. The suction openings 9 are spaced apart in the longitudinal direction of the tube with a spacing distance of preferably about 30 cm or slightly more.

When there is suction inside the tube 1, some suction occurs also below the tube in the natural duct 8. Water is then drawn through the ground into the duct 8 in the direction of the arrows shown in FIG. 2 and these streams are very slow, because of the very large cross-sectional area of the natural duct 8. Due to the slow flow of water through the ground, the risk of washing small particles from the ground into the tube is considerably reduced, and hence, only relatively clean water is drawn through the openings 9.

The invention is not limited to the embodiments shown, since several modifications thereof are clearly feasible within the scope of the following claims. Thus, for example, in place of a fan the air extracting means can be a high capacity vacuum pump and such equipment is intended to be included in the phrase "fan means" as used in the following claims.

We claim:

1. A system for draining an area of ground, said system comprising an array of tubes under the ground surface and pumping means for drawing water from said area through said tubes, said pumping means comprising a dual function system including liquid pumping means arranged to apply suction to said array of tubes to draw water into said array of tubes, and high capacity air pumping means, said liquid pumping means and said air pumping means being connected to operate in parallel, whereby said air pumping means is connected to withdraw air being drawn into said array of tubes by the suction provided by said liquid pumping means and to maintain a considerably reduced pressure in the air volume thus brought to the suction side of said liquid pumping means, thereby enabling said liquid pumping means to continuously withdraw water from said tubes substantially undisturbed by said air.

2. A system according to claim 1, in which the tubes are provided with openings in the tube wall, each having a free area of at the most 15 $mm^2$.

3. A system according to claim 1, in which the tubes are provided with openings in the tube wall, each having a free area of at the most 10 $mm^2$.

4. A system according to claim 2, in which the openings are spaced along each tube with a spacing distance of at least 20 cm.

5. A system according to claim 3, in which the openings are spaced along each tube with a spacing distance of at least 20 cm.

6. A system according to claim 2, in which the openings are spaced along each tube with a spacing distance of at least 30 cm.

7. A system according to claim 3, in which the openings are spaced along each tube with a spacing distance of at least 30 cm.

8. A system according to claim 1, in which the liquid pumping means is reversible to pump liquid from a reservoir into the ground via the tubes.

9. The use of a system according to claim 1 for injecting water into the ground through said tubes to regulate the temperature of the ground.

10. The use claimed in claim 9 for defrosting the ground.

11. The use of a system according to claim 1 for injecting treated sewage water via said tubes into said area.

12. The use of a system according to claim 1, for repeated irrigating and draining of said area in order to leech out salt deposits and/or other undesired material.

13. A system according to claim 1, in which sensor means are arranged to indicate the presence of air flow in some of said tubes and switch means are provided for activating air pumping means operating in a group of said tubes including the tubes where air flow has been indicated.

14. A system according to claim 13, in which said sensor means are arranged to automatically switch on said air pumping means upon sensing a substantial air flow.

15. A system according to claim 1, in which substantially the entire underside of each of said tubes is concave and in which each tube has a plurality of small tube wall penetrating openings in the top portion of its concave underside.

16. A system according to claim 1, in which the air pumping means is a high capacity vacuum pump.

17. A system according to claim 1 in which the air pumping means is connected to the array of tubes through one-way valve means preventing the flow of air in reverse direction through the air pumping means, thereby allowing the liquid pumping means to apply suction to said array of tubes when the air pumping means is not operating.

* * * * *